US005732413A

United States Patent [19]

Williams

[11] Patent Number: 5,732,413

[45] **Date of Patent: *Mar. 31, 1998**

[54] WATERPROOF GLOVE AND METHOD OF MAKING SAME

[76] Inventor: Cole Williams, 2408 Allenjay Pl., Glendale, Calif. 91208

[ * ] Notice: The term of this patent shall not extend beyond the expiration date of Pat. No. 5,483,703.

[21] Appl. No.: 553,040

[22] Filed: Nov. 3, 1995

Related U.S. Application Data

[63] Continuation-in-part of Ser. No. 959,115, Oct. 9, 1992, Pat. No. 5,483,703.

[51] Int. Cl.[6] ..... A41D 19/02

[52] U.S. Cl. ..... 2/169; 2/168

[58] Field of Search ..... 2/239, 409, 87, 2/243.1, 161.7, 158, 159, 167, 164, 168; 156/212, 213, 306.6, 308.2, 309.6, 322, 292, 290, 148; 264/222; 36/4, 9 R, 10; 12/142 G

[56] References Cited

U.S. PATENT DOCUMENTS

| | | | |
|---|---|---|---|
| 3,114,915 | 12/1963 | Gross | 2/158 |
| 3,625,790 | 12/1971 | Ayres | 2/159 |
| 3,945,049 | 3/1976 | Barlow | 2/167 |
| 4,194,041 | 3/1980 | Gore et al. | 2/82 |
| 4,310,373 | 1/1982 | Schuhmacher et al. | 156/308 |
| 4,662,006 | 5/1987 | Ross, Jr. | 2/158 |
| 4,679,257 | 7/1987 | Town | 2/164 |
| 4,809,447 | 3/1989 | Pacanowsky et al. | 36/9 R |
| 4,845,862 | 7/1989 | Phillips, Jr. et al. | 36/9 R |
| 5,123,119 | 6/1992 | Dube | 2/168 |
| 5,325,541 | 7/1994 | Willard | 2/239 |
| 5,430,896 | 7/1995 | Bisley | 2/239 |
| 5,442,818 | 8/1995 | Loos | 2/169 |
| 5,483,703 | 1/1996 | Williams | 2/159 |

*Primary Examiner*—Gloria Hale
*Attorney, Agent, or Firm*—James E. Brunton

[57] ABSTRACT

An article of clothing and the method of making the same which will allow water vapor due to perspiration to transpire through the article but will prevent liquid water from external sources from reaching the wearer's extremity. One form of the article of the invention comprises a sock which is of three-ply construction with the inside and outside plies being knit and the intermediate ply being made from a stretch and return polyurethane film. The three plies are uniquely bonded together using a pliant, waterproof adhesive. Another form of the mandrel comprises a glove which is of a similar three-ply construction.

29 Claims, 2 Drawing Sheets

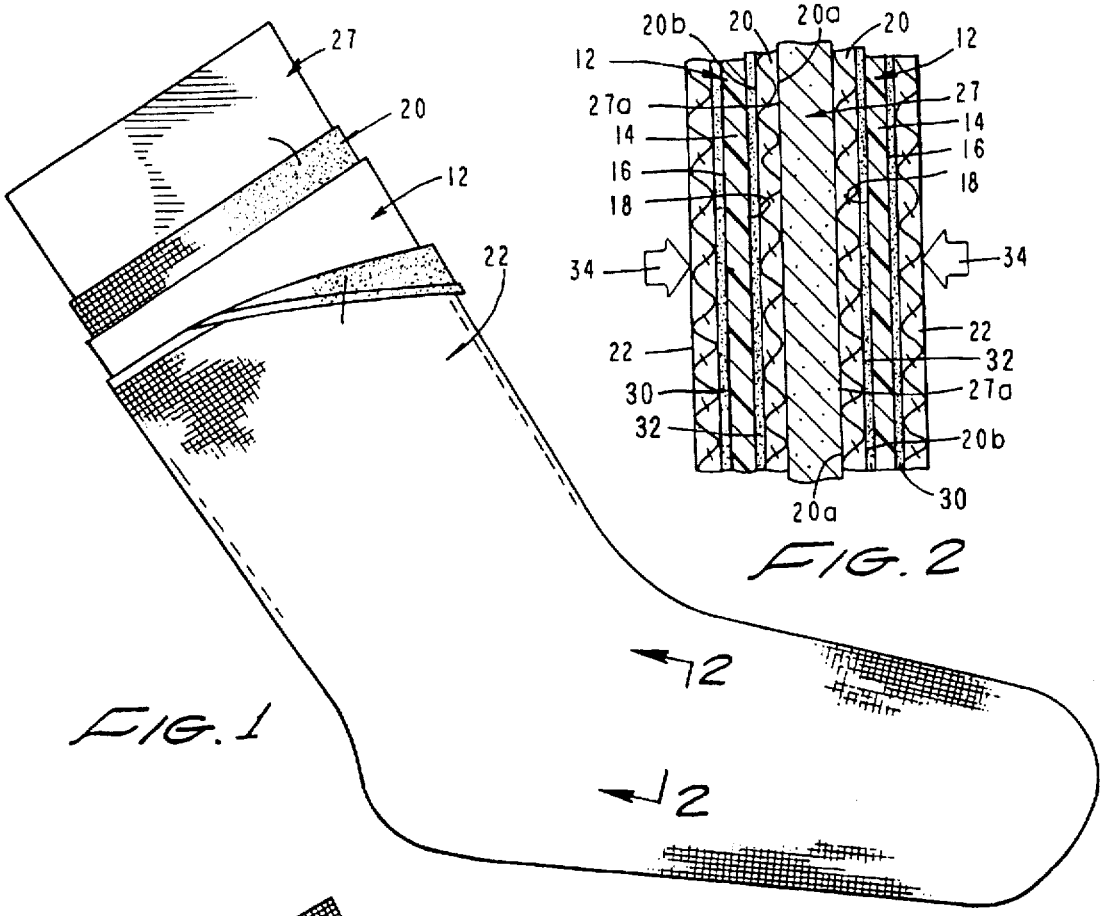
FIG. 1
FIG. 2
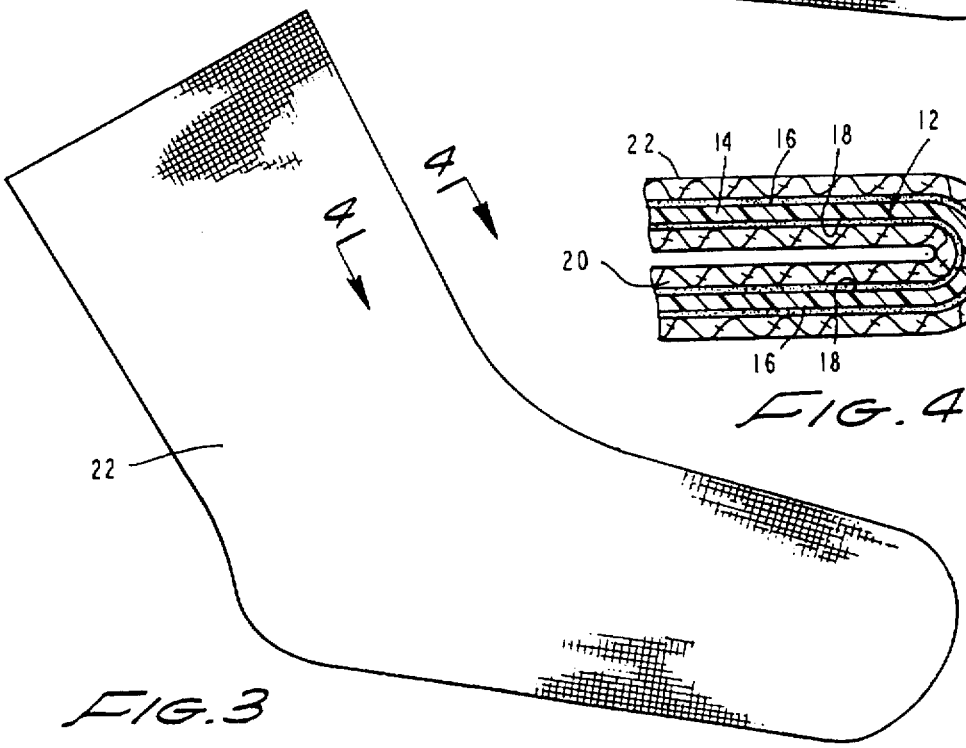
FIG. 3
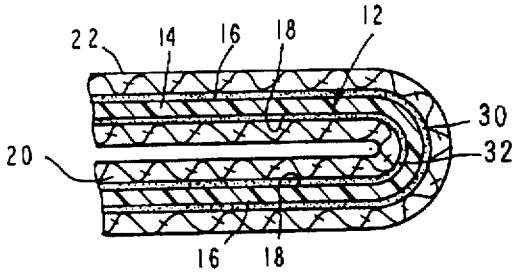
FIG. 4

WATERPROOF GLOVE AND METHOD OF MAKING SAME

This is a Continuation-in-Part application of application, Ser. No. 07/959,115 filed Oct. 9, 1992, now U.S. Pat. No. 5,483,703.

BACKGROUND OF THE INVENTION

1. Field of the Invention

The present invention relates generally to articles of apparel. More particularly, the invention concerns articles of apparel used to cover the wearer's extremities such as an improved, waterproof sock that will permit perspiration to transpire through the sock, but will keep water from external sources away from the wearer's foot.

2. Discussion of the Invention

Various attempts have been made in the past to produce breathable, waterproof articles of apparel such as gloves and socks that will keep the wearer's hands and feet dry and at the same time permit perspiration to transpire through the article. Materials which will accomplish this desired function have been known for sometime for example, U.S. Pat. No. 3,953,566 discloses a method of making an expanded polytetrafluoroethylene (PTFE) that possesses the properties of being both breathable and waterproof. An improvement of this material is described in U.S. Pat. No. 4,194,041. While both of these materials have been used in the construction of footwear, they exhibit the drawback that they have limited stretchability, thereby making them less than ideally suited for construction of footwear such as socks. In addition, such footwear typically has sewn seems and tapes which make it bulky and uncomfortable.

In an apparent attempt to overcome the problems discussed in the preceding paragraph, a multi-component sock type article was suggested. This article, which is described in U.S. Pat. No. 4,819,447 issued to Pacanowsky, et al., comprises a waterproof, nonelastic, non-stretch sole component, a non-stretch calf component and a vamp component attached to the sole and calf components.

As will be better appreciated from the discussion which follows, the footwear article of the present invention provides, for the first time, footwear such as socks construction which exhibit the comfort and stretchability of a traditional type of sport sock and at the same time are both breathable and completely waterproof.

SUMMARY OF THE INVENTION

It is an object of the present invention to provide comfortable articles of apparel and the method of making the same which will allow water vapor due to perspiration to transpire through the article but will prevent water from external sources from reaching the wearer's extremities.

A particular object of the invention is to provide a footwear article of the aforementioned character which fits well, is pliant and is durable in use.

Another object of the invention is to provide an article such as a glove or sock in which water vapor from perspiration can be transmitted from inside to outside so that the natural evaporative cooling effect can be achieved.

Another object of the invention is to provide a method of making articles of the character described in the preceding paragraphs which is simple and straight forward, does not require the use of complicated equipment such as sewing and seaming equipment and can be performed by unskilled workmen with a minimum of training.

A particular object of the invention is to provide a sock as described in the preceding paragraphs which is of simple construction and is easy to manufacture.

In its preferred form, the footwear article of the invention comprises a sock which is of three-ply construction with the inside and outside plies being knit and the intermediate ply being made from an elastomeric polyurethane film. The three-plies are uniquely bonded together using a pliant, waterproof adhesive.

BRIEF DESCRIPTION OF THE DRAWINGS

FIG. 1 is a side-elevational view illustrating the method of making the footwear article of the invention and showing the components of the article in position over a foot-shaped planar mandrel.

FIG. 2 is an enlarged cross-sectional view taken along lines 2—2 of FIG. 1.

FIG. 3 is a side-elevational view of one form of the footwear article of the invention.

FIG. 4 is an enlarged cross-sectional view taken along lines 4—4 of FIG. 3.

DESCRIPTION OF THE INVENTION

Figure 5:
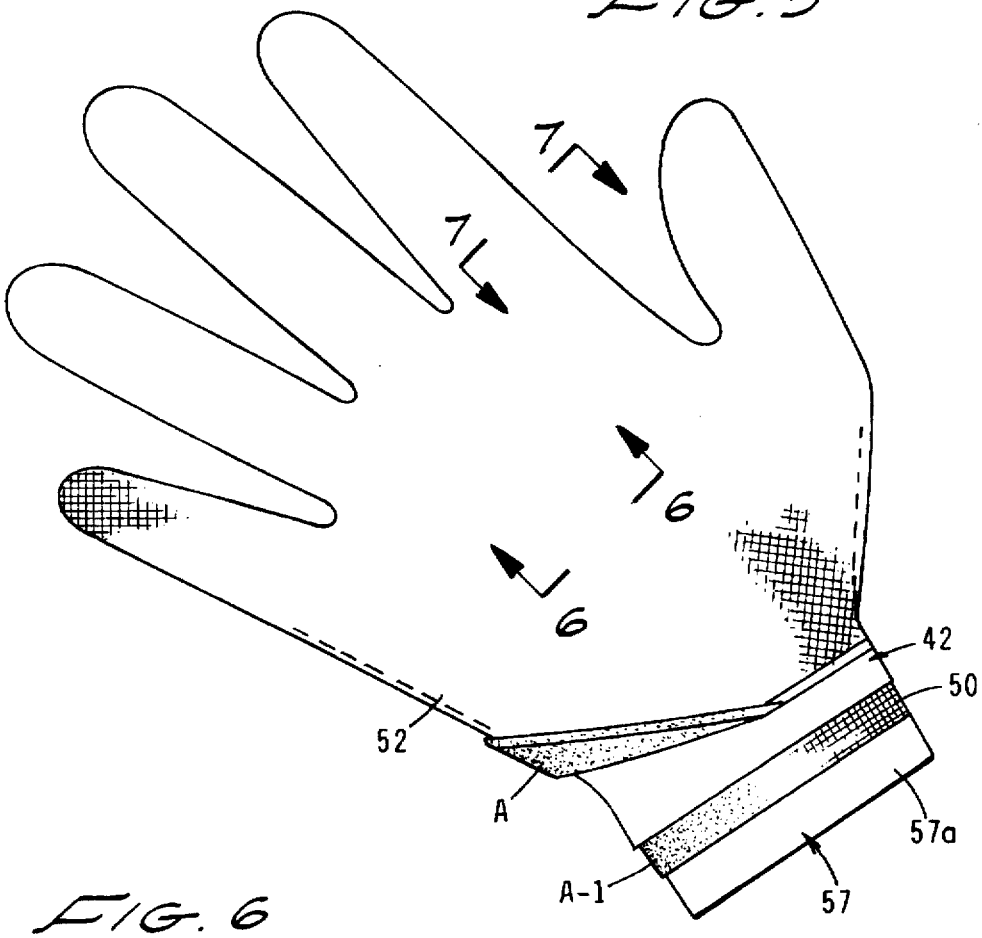
FIG. 5 is a top plan view illustrating the method of making a glove article of the invention and showing the components of the article in position over a hand-shaped planar mandrel.

In the description which follows:

The term "breathable" means the ability of an article to transport interior moisture vapor to the external environment.

As used herein, the term "waterproof" means the ability of an article to substantially prevent liquid water from external sources from reaching the interior of the article. Similarly, the term "fabric" as used herein means a material made by weaving, knitting, or felting, fibers.

The term "sock" as used herein means a short, close-fitting covering for the foot and lower leg constructed from any suitable material such as natural and synthetic fibers.

Referring to the drawings, FIGS. 3 and 4 show one form of the clothing article of the present invention. The article here comprises a sock construction including a thin, pliant bladder 12 constructed from a waterproof, breathable material, such as polyurethane sheet. Bladder 12 includes a foot portion 14 having an outer surface 16 and an inner surface 18. Bladder 12 has the unique capability of generally conforming to the contours of the human foot so that it can be comfortably worn inside a boot or shoe.

Bonded to the inner surface 18 of the bladder is a lightweight covering member such as a fabric inner sock 20 of standard construction which is preferably made from knitted natural or synthetic fibers.

The article of the invention shown in FIG. 3 also includes an outer sock 22 which is bonded to the outer surface of bladder 12. Outer sock 22 can also be constructed from filament or spun yarns. The outer sock can also be constructed from natural fibers; such as wool fibers, or from a variety of synthetic fibers such as polyester nylon and combinations thereof.

Inner and outer socks 20 and 22 are preferably bonded to bladder 12 by means of a waterproof, heat activated adhesive. A water-borne urethane heat activated, two stage fluid adhesive sold by Stahl U.S.A. of Peabody, Mass., under the designation UE-41742 has proved satisfactory for this purpose. Other adhesives can, of course, also be used, including breathable adhesives. In any event, the adhesive should be selected and applied in a manner that the breathability of the footwear is not destroyed or substantially reduced.

For certain applications the footwear article of the invention can be constructed by bonding to the bladder only a single inner or outer sock. This two, rather than three-ply construction, can be used in a number of applications in which the three or more ply constructions are too bulky or too expensive.

Considering now the method of the invention, the first step involved in the construction of the waterproof breathable bladder. In one form of the method of the invention this is accomplished by overlaying two thin sheets of thermo plastic material of a character that will prevent penetration of liquid water while at the same time permitting free passage of moisture vapor such as perspiration. This material can be a polyurethane sometimes described as thermoplastic urethane. A suitable material of this type is sold by Fabrite Laminating Corp. of Woodridge, N.J. Other suitable materials include elastomers made from polyesters, polyamides, cellulose derivatives, polyacrylic acid and its holologs, natural or synthetic rubber with hydrophilic impurities, copolyozamides, polyureas, polyelectrolytes, polyphosphates, polyvinylamide, polyvinlacohol, polyether, and copolymers thereof, polythioether, polythioetherpolyether, copolyepichlorohydrin-ether, polysulphosphates, copolyester-ether and derivatives or mixtures thereof.

The next step in the method of one form of the invention is to define on the sheets of material a line circumscribing the boundary of the bladder. This done, the sheets of material are heated along the boundary line to a temperature sufficient to sealably bond the sheets together along the boundary line.

The heating-fusion step can be accomplished in several ways well known to those skilled in the art, including using a heated wire or die having the shape of the bladder-boundary. Heating can also be accomplished through the use of well-known radio frequency and ultrasonic welding techniques.

One technique which has proven to be satisfactory in making the footwear of the invention, involves the use of a heated platen press embodying a die having the shape of the outer boundary of the bladders. The die is electrically heated to about 500 degrees Fahrenheit. One of the cooperating platens of the platen press is maintained at room temperature and, is lined with a flexible fabric such as felt. The two sheets of the bladder material, such as polyurethane film, are placed between two sheets of polytetrafluoroethylene coated fiber glass sheets which act as separator material and also allow the heat from the die to penetrate to the film. Appropriate heating of the dies causes the sheets of bladder material to be effectively welded, or sealably joined together along the boundary line to make the sock-shaped bladder. After the welding process, the excess material outside the bladder boundary is manually stripped away and the bladder is removed from the platen press.

As illustrated in FIGS. 1 and 2 of the drawings, the next step in the process of the invention is to place the first covering member, or inner sock 20 over a generally foot-shaped, approximately ⅛th inch thick, generally planar mandrel 27. Sock 20, which has inner and outer surfaces 20*a* and 20*b* is placed over the mandrel so that inner surface 20*a* thereof is disposed in engagement with the faces 27*a* of mandrel 27. As previously discussed, sock 20 can be constructed from a variety of materials. However, a sock which is made by Wigwam Mills, Inc. of Sheboygan, Wis. special knit pattern of its standard BK-1188 has proven satisfactory. An alternate inner sock, also made by Wigwam, is intended to impart cold weather comfort to the waterproof footwear article of the present invention depending on the climate encountered. For cold weather comfort, the inner sock can be made utilizing THERMAX made by E. I. duPont de Nemours and Co. of Wilmington, Del. For warm weather comfort the inner sock can be made utilizing COOLMAX made by duPont. The yarn used in this alternative sock, is a high bulk insulative blend comprising acrylic, wool and nylon fibers.

After sock 20 has been placed over mandrel 27 and smoothed out so that its inner surface is in close engagement with the faces of the mandrel 27, a light coating 30 of the Stahl UE-41742 adhesive is applied to the exposed surface of sock 20. The adhesive can be applied to sock 20 by spraying, rolling, painting or in any other customary way.

After the adhesive applied to sock 20 has dried, bladder 12 is carefully placed over the assemblage of sock 20 and mandrel 27 and is smoothed so that the inner surface of the bladder is in close engagement with the adhesive coated sock 20.

Either before or after emplacement of the bladder over the mandrel, second covering member or sock 22 is emplaced over another mandrel 27 and appropriately smoothed out. The exposed or second surface of sock 22 is then coated with a layer 32 of the Stahl UE-41742 adhesive and the adhesive is allowed to dry. The second sock is then removed from the mandrel, turned inside out and placed over bladder 12 which is mounted on the first mandrel 27 over first sock 20. With this arrangement, the adhesive coated second side of sock 22 is in engagement with the exposed surface of bladder 12.

It is to be noted that the proper application of the adhesive to the inner and outer socks is critical to the success of the manufacturing process, since, when completed, the sock must be both breathable and waterproof and it must withstand laundering and physical abuse while being worn.

The Stahl adhesive is a two-stage adhesive. It is applied in a water solution and then dried. After the adhesive has been applied and dried, it can be safely handled, stored, and manipulated. It is activated by applying heat and pressure, and when elevated to about 300 degrees F it becomes permanently set and chemical cross linking occurs.

The adhesive can also be applied to the bladder material. When this approach is followed, the adhesive can be applied by spraying, brushing, rolling or any other suitable means. A particular method which has proven satisfactory involves the use of an adhesive consisting of a mixture of 100 parts of Solucoto$^R$ 1024-5C material and 6.5 parts of Spenbond$^R$ 651. Solucoto$^R$ is sold by Soluo Chemical Co., Inc. of West Warwick, R.I. and Spenbond is sold by Reichold Chemicals, Inc. of Pensacola, Fla. When this adhesive is used, it is applied to the bladder of a dot matrix by spraying the adhesive through a perforated mylar film mask to form a multiplicity of dots of adhesive on the bladder surfaces.

When the adhesive is applied to the bladder, the adhesive is first applied to the outer surface of the bladder in the manner described to form a coated bladder. Next, the outer sock is placed over the bladder to form a subassembly. The subassembly is then turned inside out to expose the non-coated side of the bladder. A thin coat of adhesive is then applied to this surface, preferably in a dot matrix, and the inside sock, which has been turned inside out, is placed over the subassembly to form a precursor article.

It is to be understood that various adhesives, including waterproof breathable adhesives can be applied to the bladder in a number of ways well known to those skilled in the art. However, as previously mentioned, the adhesive should not detrimentally effect the free breathability of the finished article.

The precursor assembly comprising the bonded together first adhesive coated sock 20, the bladder 12 and the second adhesive coated sock 22 is then heated and compressed in the direction of the arrows 34 in FIG. 2 to form the finished article. This step is accomplished by placing the mandrel, upon which the precursor assembly is mounted, between two platens which can be controllably heated and urged together. More particularly, the platens are preferably electrically heated to a temperature of between about 280 and 310 degrees Fahrenheit and are controllably moved into pressural engagement with the precursor assembly by any type of hydraulically actuated pressure imparting assembly of a character well known to those skilled in the art. During this temperature-pressure step the polymer of the adhesive is cross linked making a permanent, waterproof bond of inner sock 20 to outside of the bladder and the outer sock 22 to the other side of the bladder. The minimum temperature required to activate the Stahl adhesive is about 280 degrees F. That temperature must be exceeded with the corresponding appropriate dwell time to cross link the adhesive polymer. Other adhesives may, of course, require that a different pressure temperature regime be followed.

The precursor assembly is then removed from the press and allowed to cool thoroughly prior to doffing the completed waterproof footwear article from the mandrel.

When removed from the mandrel, the footwear article is generally planar in shape. However, upon inserting the foot into the open cuff of the article, the foot engaging portion of the sock will neatly and smoothly conform to the shape of the wearer's foot.

It is to be understood that the method of the invention can be used to produce various articles of clothing such as socks and gloves. Such articles can be made in various sizes and design configurations to fit a wide variety of users.

Figure 6:
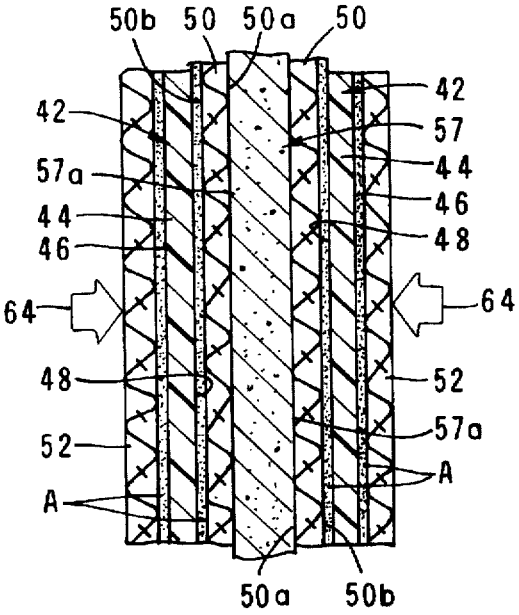
FIG. 6 is a enlarged, cross-sectional view taken along lines 6—6 of FIG. 5.
Figure 7:
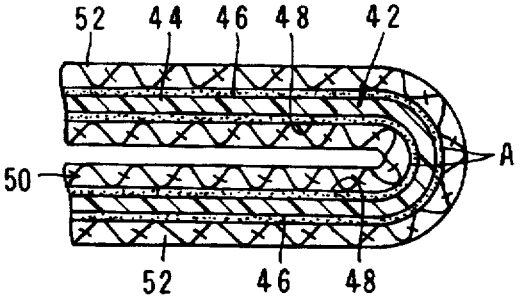
FIG. 7 is an enlarged cross-sectional view taken along lines 7—7 of FIG. 5.

Referring next to FIGS. 5 through 7 of the drawings, an alternate form of the clothing article of the present invention is there illustrated. The article here comprises a glove construction including a thin, pliant bladder 42 constructed from a waterproof, breathable material, such as polyurethane sheet. Bladder 42 includes a hand portion 44 having an outer surface 46 and an inner surface 48 (FIG. 6). Bladder 42 is of similar construction to previously described sock bladder 12, but in this case has the unique capability of generally conforming to the contours of the human hand so that it can be comfortably worn in the same manner as conventional dress or work gloves.

Bonded to the inner surface 48 of the bladder is a lightweight, generally hand-shaped covering member such as a fabric inner layer 50 of standard construction which is preferably made from knitted natural or synthetic fibers such as nylon and various types of polyesters. The glove article of the invention shown in FIGS. 5, 6, and 7 also include a hand-shaped outer layer 52 constructed of similar materials, which is bonded to the outer surface of the bladder. The choice of materials for constructing inner and outer layers 50 and 52 is quite important to the character of the final assembly. For example, elasticity is very important for the reason that the fabric layers must be stretched over the assembly forms. Therefore, the nature of the stitches in a knit fabric must be such that the fabric will stretch as the yarns adjust one against the other.

To impart the stretch quality desired to make a glove conform to a variety of differing peoples' hand, both a stretch and return characteristic in the fiber layers is also desirable. For this reason, fabrics which incorporate an elastic fiber such as fiber produced by duPont and sold under the name and style "LYCRA" have proven desirable particularly for use in construction of the outer layer 52. For certain end product applications, fabric layers embodying LYCRA brand fibers are suitable for use in constructing both the inner and outer fabric layers 50 and 52.

Knitting of the fabric layers 50 and 52 can be accomplished in various ways. For example, the knitting can be accomplished on a flat bed knitting machine of a character well known to those skilled in the art. The product of these machines is a glove which is seamless, and will conform to the hand easily because it has great stretch and resiliency. However, in the method of this latest form of the invention wherein the bladder is fitted over the inner knit component, which is, in turn, fitted over the mandrel, followed by the emplacement of the outer knit component of the bladder tends to diminish the stretch and return capability of the knitted fabric layers. Accordingly, the addition of elastic fibers such as LYCRA brand fibers, to the knitting yards, is particularly desirable when the fabric gloves are constructed using flat-bed knitting machines.

Another method of fabrication of the fabric glove components for use in the method of the invention can be accomplished using the so-called "cut & sew" method. In this technique, the fabric is first woven or knit as a flat sheet or roll of material. The sheet is then cut into pieces in an appropriate shape to be sewn together to form a glove. Using this method, an extensive array of fibers can be used. As before, the stretch and return characteristics of the fabric can be enhanced by incorporating the dupont LYCRA brand fibers in the knitting or weaving process.

Hand and glove shaped inner and outer layers members 50 and 52 are preferably bonded to bladder 42 by means of a waterproof, heat activated adhesive "A". As before, a water-borne urethane heat activated, two-stage fluid adhesive sold by Stahl U.S.A. of Peabody, Mass. under the designation of UE-41742 has proved satisfactory for this purpose. Other adhesives can, of course, also be used, including breathable adhesives. In any event, the adhesive should be selected and applied in a manner that the breathability of the article is not destroyed or substantially reduced.

For certain applications, the glove or handwear article of the invention can be constructed by bonding to the bladder only a single inner or outer fabric, glove shaped member. This two rather than three-ply construction, can be used in a number of applications in which the three or more ply constructions are too bulky or too expensive.

Considering now the method of this latest form of the invention, the first step involved in the construction of the water-proof breathable glove is accomplished by overlaying two thin sheets of thermo plastic material of a character that will prevent penetration of liquid water while at the same time permitting free passage of moisture vapor such as perspiration. This material can be a polyurethane sometimes described as thermoplastic urethane. A suitable material of this type is sold by Fabrite Laminating Corp. of Woodridge, N.J. Other suitable materials include elastomers made from polyesters, polyamides, cellulose derivatives, polyacrylic acid and its holologs, natural or synthetic rubber with hydrophilic impurities, copolyozamides, polyureas, polyelectrolytes, polyphosphates, polyvinylamide, polyvinlacohol, polyether, and copolymers thereof, polythioether, polythioether-polyether, copolyepichlorohydrin-ether, polysulphosphates, copolyester-ether and derivatives or mixtures thereof.

The next step in the method of this latest form of the invention is to define on the sheets of material a line circumscribing the boundary of the bladder. This done, the sheets of material are heated along the boundary line to a temperature sufficient to sealably bond the sheets together along the boundary line.

As in the earlier described method of the invention, the heating-fusion step can be accomplished in several ways well known to those skilled in the art, including using a heated wire or die having the shape of the bladder-boundary. Heating can also be accomplished through the use of well-known radio frequency and ultrasonic welding techniques.

The technique that has proven most satisfactory for making the glove article of the invention, involves the use of a heated platen press similar to that previously described herein which embodies a die having the shape of the outer boundary of the generally hand shaped bladder. The die is electrically heated to about 500 degrees Fahrenheit. As before, one of the cooperating platens of the platen press is maintained at room temperature and, is lined with a flexible fabric such as felt. The two sheets of the bladder material, such as polyurethane film, are placed between two sheets of polytetrafluoroethylene coated fiber glass sheets which act as separator material and also allow the heat from the die to penetrate to the film. Appropriate heating of the dies causes the sheets of bladder material to be effectively welded, or sealably joined together along the boundary line to make the generally hand-shaped bladder. After the welding process, the excess material outside the bladder boundary is manually stripped away and the bladder is removed from the platen press.

As illustrated in FIGS. 5, 6 and 7 of the drawings, the next step in the process of the invention is to place the first glove-like covering member, or inner layer 50 over a generally hand-shaped, approximately ⅛th inch thick, generally planar mandrel 57. Inner layer 50, which has inner and outer surfaces 50*a* and 50*b* is placed over the mandrel so that inner surface 50*a* is disposed in engagement with the faces 57*a* of mandrel 57. As previously discussed, member 20 can be constructed from a variety of natural and synthetic materials. For cold weather comfort, the inner member can be made utilizing the previously identified THERMAX$_R$ brand material made by E. I. duPont de Nemours and Co. of Wilmington, Del. For warm weather comfort the inner member can be made utilizing COOLMAX$_R$ brand material made by duPont.

After inner layer 50 has been placed over mandrel 57 in the manner shown in FIG. 5, a light coating A-1 of the Stahl UE-41742 adhesive is applied to the exposed inner layer 50. As before, adhesive can be applied to the inner layer 50 by spraying, rolling, painting or in any other customary way.

After the adhesive applied to inner layer 50 has dried, bladder 42 is carefully placed over the assemblage of layer 50 and mandrel 57 and is smoothed so that the inner surface of the bladder is in close engagement with the adhesive coated glove-like member or inner layer 50.

Either before or after emplacement of the bladder over the mandrel, outer or layer 52 is coated in the manner previously described with a layer of the Stahl UE-41742 adhesive and the adhesive is allowed to dry. Outer layer 52 is then turned inside out and placed over bladder 42 which is positioned on the mandrel 57 in an overlaying relationship with inner layer 50. With this arrangement, the adhesive coated second side of outer layer 52 is in engagement with the exposed surface of bladder 42 in the manner shown in FIGS. 6 and 7.

As before the Stahl adhesive is activated by applying heat and pressure, and when elevated to about 300 degrees F. it becomes permanently set and chemical cross linking occurs. In the manner previously described in connection with the method of the invention for making footwear, the adhesive can also be applied to the generally hand-shaped bladder material.

The precursor assembly comprising the bonded together inner layer 50, the bladder 42 and outer layer 52 is then heated and compressed in the direction of the arrows 64 in FIG. 6 to form the finished article. This step is accomplished by placing the mandrel, upon which the precursor assembly is mounted, between two platens which can be controllable heated and urged together. Once again, the platens are preferably electrically heated to a temperature of between about 280 and 310 degrees Fahrenheit and are controllable moved into pressural engagement with the precursor assembly by any type of hydraulically actuated pressure imparting assembly of a character well known to those skilled in the art. During this temperature-pressure step the polymer of the adhesive is cross linked making a permanent, waterproof bond of inner member 50 to outside of the bladder and the outer member 52 to the other side of the bladder. The minimum temperature required to activate the Stahl adhesive is about 280 degrees F. That temperature must be exceeded with the corresponding appropriate dwell time to cross link the adhesive polymer. Other adhesives may, of course, require that a different pressure temperature regime be followed.

The precursor assembly is then removed from the press and allowed to cool thoroughly prior to doffing the completed waterproof glove from the mandrel.

When removed from the mandrel, the glove is generally planar in shape. However, upon inserting the hand into the open cuff of the article, the glove body will neatly and smoothly conform to the shape of the wearer's hand.

While different mandrels can be used to produce right and left hand waterproof, breathable gloves, a single mandrel of the character shown in FIG. 5 can be used to produce a glove that is ambidextrous. That is, two identical gloves will make a pair either of which can be worn on either the right or left hand.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A method of making a waterproof glove comprising the steps of:

(a) forming a waterproof, breathable material into a stretchable bladder having an open cuff portion and a continuous hand receiving portion having the general shape of the wearer's hand including a continuous outer surface and a continuous inner surface generally conformable to the contours of the wearer's hand; and (b) bonding a first generally hand-shaped covering member having an inner surface and an outer surface directly to said inner surface of said hand receiving portion of said bladder to form a subassembly portion of said article, said first generally hand-shaped covering member being made from a yarn comprising elastic fibers, said bonding being accomplished by the steps of applying a thin layer of adhesive to a selected one of said inner surface of said hand receiving portion of said stretchable bladder and said outer surface of said hand-shaped covering member and then placing said bladder over said first generally hand-shaped covering.

2. A method as defined in claim 1 including the further step of bonding a second generally hand-shaped covering member to said outer surface of said hand receiving portion of said bladder to form a precursor article, said bonding being accomplished by the step of applying a thin layer of adhesive to a selected one of said outer surface of said hand-receiving portion of said stretchable bladder and said inner surface of said hand-shaped covering member and then placing said second generally hand-shaped cover over said bladder.

3. A method as defined in claim 1 in which said waterproof, breathable material comprises a thin film.

4. A method as defined in claim 3 in which said thin film comprises urethane.

5. A method as defined in claim 3 in which said first generally hand-shaped covering member is bonded to said inner surface of said hand receiving portion of said bladder using a waterproof adhesive.

6. A method as defined in claim 3 in which said first generally hand-shaped covering member is bonded to said inner surface of said hand receiving portion of said bladder using a heat activated adhesive.

7. A method as defined in claim 6 including the further step of heating said subassembly.

8. A method as defined in claim 7 in which said subassembly is heated to a temperature of between approximately 280 degrees F. and 310 degrees F.

9. A method as defined in claim 7 including the further step of compressing said subassembly during heating.

10. A method of making a waterproof glove constructed of an inner fabric member, an outer fabric member and an intermediate pliant, waterproof, breathable bladder having a continuous hand-receiving portion in the general shape of the wearer's hand and having a continuous inner and outer surface, said method comprising the steps of:

(a) applying a thin layer of heat activated adhesive over the outer surface of the inner fabric member to form a coated inner member;

(b) placing the bladder over the coated inner fabric member to form a subassembly;

(c) applying a thin layer of adhesive over the inner surface of the outer fabric member to form a coated outer member;

(d) placing said coated outer fabric member over said subassembly so that said layer of adhesive is proximate said bladder to form a precursor article; and (e) heating said precursor article to a temperature sufficient to activate said heat activated adhesive whereby said inner and outer members will be adhesively bonded to the continuous inner and outer surfaces of the bladder.

11. A method as defined in claim 10 in which said precursor article is compressed during said heating step in a manner to urge said inner and outer members into close proximity with said bladder.

12. A method as defined in claim 10 in which said adhesive comprises urethane polymer and in which said assembly is heated to a temperature sufficient to cross link said urethane polymer.

13. A method as defined in claim 12 in which said assembly is heated to a temperature of approximately 300 degrees Fahrenheit.

14. A method as defined in claim 12 in which said bladder comprises a thin, elastomeric polyurethane film.

15. A method as defined in claim 14 in which said first and second fabric members comprise yarns made of fibers.

16. A method as defined in claim 14 in which said first and second fabric member comprise yarns made of synthetic fibers and elastic fibers.

17. A method as defined in claim 14 in which said first and second fabric members comprise a material selected from the group consisting of nylon, polyester, aramids, and combinations thereof.

18. A two-ply article of apparel used to cover a wearer's hand comprising:

(a) a pliant, generally extremity-shaped hollow bladder constructed from a thin waterproof, breathable membrane, said bladder including as a part thereof, a continuous hand covering portion for substantially enclosing therewithin the user's hand including a continuous outer surface and a continuous inner surface generally conforming to the user's hand; and (b) a generally hand-shaped covering member having a continuous surface attached by adhesive bonding directly to one of said continuous inner and outer surfaces of said bladder along a substantial portion thereof.

19. An article as defined in claim 18 in which said elastomeric bladder permits the water vapor content of perspiration to pass through in a direction toward said outer member, but blocks passageway thereof of liquid water in an opposite direction.

20. A three-ply article of apparel used to cover a wearer's hand comprising:

(a) a pliant, generally extremity-shaped hollow bladder constructed from a thin waterproof, breathable membrane, said bladder including as a part thereof, a continuous hand covering portion for substantially enclosing therewithin the user's hand including a continuous outer surface and a continuous inner surface generally conforming to the user's hand;

(b) a first generally hand-shaped covering member having a continuous surface attached directly by adhesive bonding to said continuous inner surface of said bladder along a substantial portion thereof; and (c) a second generally hand-shaped covering member having a continuous surface attached by adhesive bond directly to said continuous outer surface of said bladder along a substantial portion thereof.

21. An article as defined in claim 20 in which said first and second generally hand-shaped covering members are constructed from fabric.

22. An article as defined in claim 20 in which said first and second generally hand-shaped covering members are constructed from fibers selected from the group consisting of nylon, polyester, aramids, and combinations thereof.

23. An article as defined in claim 20 in which said first and second generally hand-shaped covering members are constructed from synthetic fibers and elastic fibers.

24. A method of making a waterproof glove constructed of an inner member, an outer member and an intermediate pliant, waterproof, breathable bladder having a continuous hand-receiving portion in the general shape of the wearer's hand and having a continuous inner an outer surface, said method comprising the steps of:

(a) applying a thin layer of heat activated adhesive over a selected one of the outer surface of the inner member and the inner surface of the breathable bladder;

(b) placing the bladder over the inner member to form a subassembly;

(c) applying a thin layer of adhesive over a selected one of the inner surface of the outer member and the outer surface of the breathable bladder;

(d) placing said outer member over said subassembly to form a precursor article; and (e) heating said precursor article to a temperature sufficient to activate said heat activated adhesive whereby said inner and outer members will be adhesively bonded to the continuous inner and outer surfaces of the bladder.

25. A method as defined in claim 24 in which said precursor article is compressed during said heating step in a manner to urge said inner and outer members into close proximity with said bladder.

26. A method as defined in claim 24 in which said adhesive comprises urethane polymer and in which said assembly is heated to a temperature sufficient to cross link said urethane polymer.

27. A method as defined in claim 24 in which said bladder comprises a thin, elastomeric polyurethane film.

28. A method as defined in claim 24 in which said first and second members comprise fabric members.

29. A method as defined in claim 28 in which said first and second fabric members comprise fabric made of synthetic fibers and elastic fibers.

* * * * *